US011012797B2

(12) United States Patent
Andersson et al.

(10) Patent No.: US 11,012,797 B2
(45) Date of Patent: May 18, 2021

(54) BONE CONDUCTION DEVICE HAVING MAGNETS INTEGRATED WITH HOUSING

(71) Applicant: Cochlear Limited, Macquarie University (AU)

(72) Inventors: Marcus Andersson, Mölnlycke (SE); Martin Evert Gustaf Hillbratt, Mölnlycke (SE); Johan Gustafsson, Mölnlycke (SE); Tommy Bergs, Mölnlycke (SE)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 16/010,150

(22) Filed: Jun. 15, 2018

(65) Prior Publication Data

US 2018/0302728 A1 Oct. 18, 2018

Related U.S. Application Data

(63) Continuation of application No. 15/158,156, filed on May 18, 2016, now Pat. No. 10,009,698.

(60) Provisional application No. 62/268,402, filed on Dec. 16, 2015.

(51) Int. Cl.
*H04R 25/00* (2006.01)

(52) U.S. Cl.
CPC ..... *H04R 25/606* (2013.01); *H04R 2225/67* (2013.01)

(58) Field of Classification Search
CPC .. H04R 2225/67; H04R 25/00; H04R 25/606; H04R 25/556; H04R 25/65; H04R 25/60; A61N 1/3787; A61N 1/0541; A61N 1/36038; A61N 1/3758; H01H 36/00
USPC ..... 324/76.49; 381/151, 312, 313, 318, 320, 381/323, 326, 328; 600/25, 559, 57; 604/140; 607/55, 57, 56, 137; 623/10, 623/11.11; 704/271; 73/664; 310/81, 310/328; 451/392
See application file for complete search history.

(56) References Cited

U.S. PATENT DOCUMENTS 4,612,915 A 9/1986 Hough et al.
4,726,378 A 2/1988 Kaplan
5,163,957 A * 11/1992 Sade ..... A61F 2/18 381/326
6,516,228 B1 * 2/2003 Berrang ..... H04R 25/606 607/57
6,560,488 B1 * 5/2003 Crawford ..... A61N 1/3787 607/56
6,643,378 B2 11/2003 Schumaier
7,676,372 B1 * 3/2010 Oba ..... G09B 21/009 434/169

(Continued)

OTHER PUBLICATIONS

International Search Report and the Written Opinion of the International Searching Authority for PCT/IB2016/001860, dated Apr. 28, 2017, 13 pages.

*Primary Examiner* — Gerald Gauthier
(74) *Attorney, Agent, or Firm* — Edell, Shapiro & Finnan, LLC

(57) ABSTRACT

A transcutaneous bone conduction device includes magnets secured to housing of an external portion of the device. The magnets can be disposed within the housing, or secured to an external surface thereof. The magnets are disposed about a shaft that delivers vibrational stimuli to a recipient so as to evenly deliver the stimuli.

25 Claims, 12 Drawing Sheets

(56) References Cited

U.S. PATENT DOCUMENTS 8,005,247 B2 * 8/2011 Westerkull ..... H04R 25/00 381/318
8,241,201 B2 * 8/2012 Hakansson ..... H04R 25/606 600/25
8,891,795 B2 11/2014 Andersson
8,897,475 B2 * 11/2014 Ball ..... H04R 25/606 381/326
9,022,917 B2 5/2015 Kasic et al.
9,031,274 B2 5/2015 Kasic, II
9,179,228 B2 11/2015 Ruppersberg et al.
9,210,521 B2 12/2015 Kasic et al.
9,526,810 B2 12/2016 Ruppersberg
9,736,601 B2 8/2017 Kasic et al.
9,788,125 B2 10/2017 Ruppersberg et al.
RE46,624 E * 12/2017 Zimmerling ..... A61N 1/37
10,003,898 B1 * 6/2018 Bjorn ..... H04R 25/606
10,009,698 B2 6/2018 Andersson et al.
10,419,861 B2 * 9/2019 Morris ..... H04R 11/00
2002/0120332 A1 * 8/2002 Law ..... A61N 1/0526 623/11.11
2004/0032962 A1 2/2004 Westerkull
2004/0133065 A1 * 7/2004 Easter ..... H04R 25/606 600/25
2004/0210103 A1 * 10/2004 Westerkull ..... H04R 25/606 600/25
2005/0197524 A1 * 9/2005 Miller, III ..... H04R 25/604 600/25
2006/0045298 A1 * 3/2006 Westerkull ..... H02K 33/18 381/326
2006/0056649 A1 3/2006 Schumaier
2007/0053536 A1 * 3/2007 Westerkull ..... H04R 25/606 381/326
2007/0057601 A1 * 3/2007 Kawase ..... H04R 17/00 310/328
2009/0138062 A1 * 5/2009 Balslev ..... A61B 5/123 607/55
2009/0143839 A1 * 6/2009 Zimmerling ..... A61N 1/375 607/57
2009/0199644 A1 8/2009 Aoyagi
2009/0216324 A1 * 8/2009 Leigh ..... A61N 1/0541 623/10
2009/0248155 A1 10/2009 Parker
2009/0281366 A1 * 11/2009 Basinger ..... H04R 25/606 600/25
2009/0285417 A1 11/2009 Shin et al.
2009/0287278 A1 * 11/2009 Charvin ..... A61N 1/375 607/57
2010/0036458 A1 * 2/2010 Duftner ..... A61N 1/37229 607/57
2010/0046779 A1 * 2/2010 Crawford ..... H04R 25/602 381/328
2010/0048983 A1 * 2/2010 Ball ..... A61N 1/36036 600/25
2010/0198303 A1 * 8/2010 Haller ..... A61N 1/36036 607/57
2011/0022120 A1 * 1/2011 Ball ..... A61N 1/08 607/57
2011/0101796 A1 5/2011 Odajima et al.
2011/0130622 A1 * 6/2011 Ilberg ..... A61N 1/37229 600/25
2011/0224789 A1 * 9/2011 Griffith ..... A61N 1/37229 623/10
2011/0268303 A1 * 11/2011 Ahsani ..... H04R 11/02 381/326
2012/0088956 A1 * 4/2012 Asnes ..... H04R 25/606 600/25
2012/0109006 A1 * 5/2012 James ..... A61N 1/37247 600/559
2012/0237067 A1 * 9/2012 Asnes ..... H04R 9/025 381/326
2012/0286765 A1 * 11/2012 Heuvel ..... H04R 25/606 324/76.49
2012/0296155 A1 * 11/2012 Ball ..... A61N 1/3718 600/25
2012/0302823 A1 * 11/2012 Andersson ..... H04R 25/606 600/25
2013/0018218 A1 * 1/2013 Haller ..... H04R 25/60 600/25
2013/0064404 A1 * 3/2013 Ridler ..... H04R 25/405 381/313
2013/0076178 A1 * 3/2013 Kuroda ..... H02K 5/24 310/81
2013/0163791 A1 * 6/2013 Ql; Xin ..... H04R 1/00 381/151
2013/0165738 A1 * 6/2013 Ball ..... H04R 15/00 600/25
2013/0195304 A1 * 8/2013 Andersson ..... H04R 25/606 381/326
2013/0281764 A1 * 10/2013 Bjorn ..... H04R 25/606 600/25
2014/0012071 A1 * 1/2014 Nagl ..... A61N 1/36036 600/25
2014/0025138 A1 * 1/2014 Meskens ..... H04R 25/606 607/57
2014/0035397 A1 2/2014 Endo et al.
2014/0105434 A1 * 4/2014 Goorevich ..... A61N 5/0622 381/320
2014/0121451 A1 * 5/2014 Kasic ..... H04R 25/606 600/25
2014/0163309 A1 * 6/2014 Bernhard ..... H04R 25/606 600/25
2014/0202252 A1 * 7/2014 Umehara ..... B06B 1/045 73/664
2014/0233765 A1 * 8/2014 Andersson ..... H04R 25/606 381/151
2014/0235146 A1 * 8/2014 Mingot ..... B24B 7/02 451/392
2014/0275731 A1 * 9/2014 Andersson ..... H04R 25/606 600/25
2014/0288356 A1 * 9/2014 Van Vlem ..... H04R 25/305 600/25
2014/0343626 A1 * 11/2014 Thenuwara ..... A61N 1/375 607/57
2015/0012058 A1 * 1/2015 Crawford ..... H04R 25/554 607/57
2015/0045607 A1 * 2/2015 Hakansson ..... H04R 25/606 600/25
2015/0049889 A1 * 2/2015 Bern ..... H04R 25/456 381/312
2015/0063611 A1 * 3/2015 Hillbratt ..... H04R 25/606 381/312
2015/0092969 A1 * 4/2015 Meskens ..... H04R 25/606 381/323
2015/0137627 A1 5/2015 Katada et al.
2015/0156594 A1 * 6/2015 Bervoets ..... H04R 1/2876 600/25
2015/0215710 A1 * 7/2015 Francart ..... H04R 25/356 381/326
2015/0312687 A1 * 10/2015 Andersson ..... H04R 25/606 600/25
2015/0373461 A1 * 12/2015 Andersson ..... H04R 9/025 600/25
2015/0374964 A1 * 12/2015 Verhoeven ..... A61M 5/1428 604/140
2015/0382114 A1 * 12/2015 Andersson ..... H04R 25/606 600/25
2016/0023006 A1 * 1/2016 Ridler ..... A61N 1/37229 607/57
2016/0037273 A1 * 2/2016 Gustafsson ..... H04R 25/606 600/25
2016/0058555 A1 3/2016 Andersson et al.
2016/0096019 A1 * 4/2016 Dhanasingh ..... A61B 90/11 607/137
2016/0112812 A1 * 4/2016 Vermeiren ..... H04R 25/606 600/25
2016/0219383 A1 * 7/2016 Ridler ..... H04R 25/556
2016/0234613 A1 8/2016 Westerkull
2017/0019008 A1 1/2017 Berrezag

(56) References Cited

U.S. PATENT DOCUMENTS

| | | | | |
|---|---|---|---|---|
| 2017/0078808 | A1* | 3/2017 | Kennes | H04R 25/606 |
| 2017/0094429 | A1* | 3/2017 | Bervoets | H04R 25/606 |
| 2017/0156010 | A1* | 6/2017 | Verma | H04R 25/606 |
| 2017/0173334 | A1* | 6/2017 | Zimmerling | A61N 1/05 |
| 2017/0180891 | A1* | 6/2017 | Johansson | H04R 25/606 |
| 2018/0302728 | A1* | 10/2018 | Andersson | H04R 25/606 |
| 2019/0141461 | A1* | 5/2019 | Gustafsson | H04R 25/606 |
| 2019/0239007 | A1* | 8/2019 | Kennes | H04R 25/60 |
| 2019/0261099 | A1* | 8/2019 | Crawford | A61N 1/36036 |

* cited by examiner

BONE CONDUCTION DEVICE HAVING MAGNETS INTEGRATED WITH HOUSING

CROSS-REFERENCE TO RELATED APPLICATIONS

This application claims priority to and the benefit of U.S. patent application Ser. No. 15/158,156, filed May 18, 2016, which claims priority to and the benefit of U.S. Provisional Patent Application No. 62/268,402, filed Dec. 16, 2015. The disclosures of these applications are incorporated by reference herein in their entireties.

BACKGROUND

Hearing loss, which can be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient (i.e., the inner ear of the recipient) to bypass the mechanisms of the middle and outer ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss can retain some form of residual hearing because some or all of the hair cells in the cochlea function normally.

Individuals suffering from conductive hearing loss often receive a conventional hearing aid. Such hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to conventional hearing aids, which rely primarily on the principles of air conduction, certain types of hearing prostheses commonly referred to as bone conduction devices, convert a received sound into vibrations. The vibrations are transferred through the skull to the cochlea causing motion of the perilymph and stimulation of the auditory nerve, which results in the perception of the received sound. Bone conduction devices are suitable to treat a variety of types of hearing loss and can be suitable for individuals who cannot derive sufficient benefit from conventional hearing aids.

SUMMARY

A transcutaneous bone conduction device includes magnets disposed on the housing of an external portion of the device. By disposing the magnets on the housing, rather than on or in the pressure plate, the overall height of the device is reduced. This can reduce the obtrusiveness of the device and prevent the device from being caught on clothing and dislodged. In examples, magnets of differing magnet strengths can be secured as needed to the housing so as to accommodate the needs of different recipients.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Figure 1:
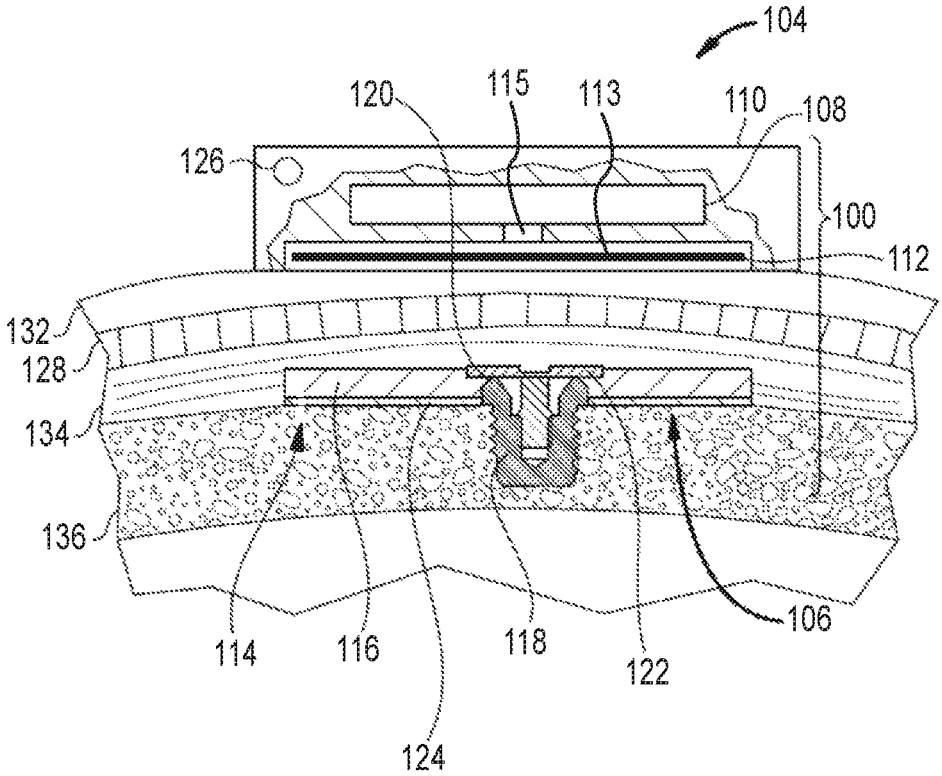
FIG. 1 depicts a partial cross-sectional schematic view of a passive transcutaneous bone conduction device worn on a recipient.

The technologies described herein can be utilized in auditory prostheses such as bone conduction devices. Passive transcutaneous bone conduction devices deliver stimuli from an external transducer to the skull via an external plate that directly vibrates the skull, through the intervening tissue. Such auditory prostheses deliver a hearing percept to a recipient of the prosthesis. One or more retention magnets associated with an external portion of the bone conduction device magnetically engage with one or more implanted magnets disposed below the surface of the skin of a patient. The retention magnets are disposed in or on a surface of the external device housing. As such, the total height that the external device projects above the skull is reduced (relative to passive transcutaneous bone conduction devices that include magnets in a vibration transmission plate). By reducing the total projection height, the device is less visible and less like to get caught on clothing and potentially dislodged.

Moreover, by disposing the magnets on the housing of the bone conduction device, the vibration actuator that delivers the stimuli to the recipient can be optimized for stimuli transmission and efficiency. In configurations where the magnets are disposed in or on the pressure plate (as depicted below in FIG. 1), the weight of the magnets can influence the frequency response of the device. This is because the magnets move with the output from the actuator. By transferring the magnets from a vibrating part of the device (e.g. the pressure plate that delivers the stimuli to the recipient) to a static or relatively static part of the device (e.g. the housing), the transmission characteristics of the device can be tuned without compromising the retention force (the force holding the device to a recipient's skull). Magnets disposed on the housing, as in the examples described herein, bear the full weight of the bone conduction device, without the need for an ear hook or other retention element.

The magnets can be secured to the housing with mechanical fasteners, adhesives, or by magnetically engaging with ferrite elements disposed within the housing.

Disposing magnets on the housing, as opposed to the pressure plate, can also benefit manufacturability of the device. For example, a modular bone conduction device can be manufactured that can be used for both percutaneous and transcutaneous applications. After manufacture, in a first example, this modular bone conduction device can be connected to a bone anchor on a recipient who requires a percutaneous solution. In a second example, that same modular bone conduction device can be fitted with a pressure plate and appropriately-sized magnets for a recipient who requires a transcutaneous solution. Indeed, in the second example, individual magnets can be selected from magnets of various strengths and secured to the housing during a fitting session. Moreover, a recipient who needs or desires to change between transcutaneous and a percutaneous applications may do so by removing the magnets from their bone conduction device and connecting that bone conduction device to a newly implanted percutaneous abutment.

FIG. 1 depicts an example of a transcutaneous bone conduction device 100 that includes an external portion 104 and an implantable portion 106. The transcutaneous bone conduction device 100 of FIG. 1 is a passive transcutaneous bone conduction device in that a vibrating actuator 108 is located in the external portion 104 and delivers vibrational stimuli through the skin 132 to the skull 136. Vibrating actuator 108 is located in housing 110 of the external component, and is coupled to a pressure or transmission plate 112. The pressure plate 112 can be in the form of a permanent magnet and/or in another form that generates and/or is reactive to a magnetic field, or otherwise permits the establishment of magnetic attraction between the external portion 104 and the implantable portion 106 sufficient to hold the external portion 104 against the skin of the recipient. In the depicted example, the pressure plate 112 is a non-magnetic material such as a rigid plastic and has embedded therein a magnet 113. In other examples, the magnet 113 is connected to, but not embedded in, the pressure plate 112, typically on a side proximate the actuator 108. Magnetic attraction is enhanced by utilization of an implantable magnetic plate 116 that is secured to the bone 136. Single magnets 113, 116 are depicted in FIG. 1. In alternative examples, multiple magnets in both the external portion 104 and implantable portion 106 can be utilized. The magnetic attraction between the external magnet 113 and the implantable magnetic plate 116 retains the external housing 110 on the recipient, without the need for adhesives, ear hooks, or other retention elements. In a further alternative example the pressure plate 112 can include an additional plastic or biocompatible encapsulant (not shown) that encapsulates the pressure plate 112 and contacts the skin 132 of the recipient.

In an example, the vibrating actuator 108 is a device that converts electrical signals into vibration. In operation, sound input element 126 converts sound into electrical signals. Specifically, the transcutaneous bone conduction device 100 provides these electrical signals to vibrating actuator 108, via a sound processor (not shown) that processes the electrical signals, and then provides those processed signals to vibrating actuator 108. The vibrating actuator 108 converts the electrical signals into vibrations. Because vibrating actuator 108 is mechanically coupled to pressure plate 112, the vibrations are transferred from the vibrating actuator 108 to pressure plate 112, via a transmission element 115 such as an output shaft. Implantable plate assembly 114 is part of the implantable portion 106, and can be made of a ferromagnetic material that can be in the form of a permanent magnet or a non-magnetic material that contains a magnet. The implantable portion 106 generates and/or is reactive to a magnetic field, or otherwise permits the establishment of a magnetic attraction between the external portion 104 and the implantable portion 106 sufficient to hold the external portion 104 against the skin 132 of the recipient. Accordingly, vibrations produced by the vibrating actuator 108 of the external portion 104 are transferred from pressure plate 112 to implantable plate 116 of implantable plate assembly 114. This can be accomplished as a result of mechanical conduction of the vibrations through the skin 132, resulting from the external portion 104 being in direct contact with the skin 132 and/or from the magnetic field between the two plates 112, 116. These vibrations are transferred without a component penetrating the skin 132, fat 128, or muscular 134 layers on the head.

As can be seen, the implantable plate assembly 114 is substantially rigidly attached to bone fixture 118 in this example. Implantable plate assembly 114 includes through hole 120 that is contoured to the outer contours of the bone fixture 118, in this case, a bone fixture 118 that is secured to the bone 136 of the skull. This through hole 120 thus forms a bone fixture interface section that is contoured to the exposed section of the bone fixture 118. In an example, the sections are sized and dimensioned such that at least a slip fit or an interference fit exists with respect to the sections. Plate screw 122 is used to secure implantable plate assembly 114 to bone fixture 118. As can be seen in FIG. 1, the head of the plate screw 122 is larger than the hole through the implantable plate assembly 114, and thus the plate screw 122 positively retains the implantable plate assembly 114 to the bone fixture 118. In certain examples, a silicon layer 124 is located between the implantable plate 116 and bone 136 of the skull.

Figure 2A:
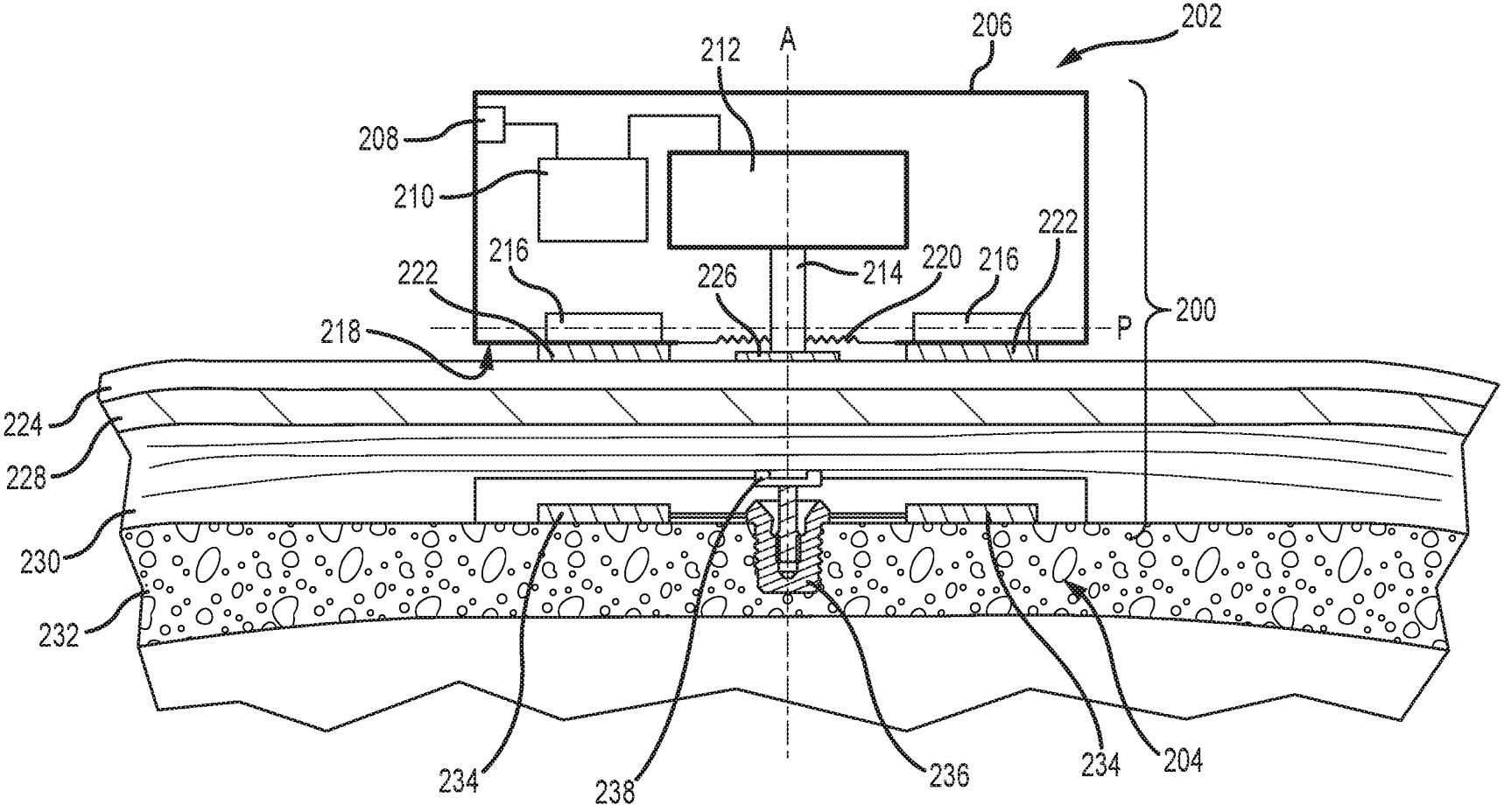
FIGS. 2A and 2B depict partial cross-sectional schematic views of passive transcutaneous bone conduction devices worn on a recipient.

FIG. 2A depicts a partial cross-sectional schematic view of a passive transcutaneous bone conduction device 200 worn on a recipient. As with the example above, the device 200 includes an external portion 202 and an implantable portion 204. The external portion 202 includes a housing 206 containing a sound input element 208, such as a microphone, that is in communication with a digital sound processor 210. The sound processor is configured to send electrical signals to a vibration actuator 212 that has an output shaft 214. In another example, the sound input element 208 and sound processor 210 can be disposed in a separate component (e.g., a behind-the-ear (BTE) device) and connected via a cable to an external component that contains the vibration actuator 212. The external portion 202 includes a plurality of magnets 216 that are disposed within the housing 206, generally proximate a lower surface 218 thereof. In the depicted example, the magnets 216 are contained within the housing 206, but in other examples, the magnets 216 can be disposed on the lower surface 218, outside of the interior of the housing 206. A flexible seal 220 disposed about the shaft 214 so as to seal the housing 206 at this location. The seal 220 prevents the ingress of water, dirt, or other contaminants. The seal 220 is also compliant so as to reduce transmission of vibrations back to the housing 206 and the components contained therein. A soft pad material 222 can be disposed on or integrated with the lower surface 218 so as to equalize the pressure distribution across the skin 224 and increase recipient comfort. The soft pad material 222 also provides a small spacing between the skin 224 and the lower surface 218, which enables placement of a transmission element, such as an enlarged pressure plate 226, that can aid in transmission of vibrations to the recipient. As above, these vibrations are transmitted through the skin 224, fat 228, and muscle 230, to the bone 232 of the skull. As with the example of FIG. 1, the implanted portion 204 of the bone conduction device 200 includes a magnetic material, in this case a plurality of implanted magnets 234 that are configured to engage magnetically with the external magnets 216. A bone fixture 236 forms a point of attachment for the implantable portion 204, which can be secured with an anchor or screw 238.

The plurality of magnets 216 from a magnet system that, when magnetically engaged with the implanted magnets 234, provide a retention force that supports the full weight of the external portion 202, preventing the external portion 202 from falling away from the head of the recipient. Since the magnets 216 support the full weight of the external portion 202, they can be referred to as retention magnets. Magnets 216, 234 having different relative strengths can be utilized for increased retention strength, increased recipient comfort, and other reasons. Magnets 216, 234 having a variety of retention strengths can be selected based on the thickness of the skin flap (a thicker skin flap results in a greater distance between the magnets 216, 234, which requires stronger magnets), external portion 202 weight (based on the combined weight of the sound processor 210, vibration actuator 212, and other components contained within the common housing 206), and so on.

Although only two magnets 216, 234 are depicted in FIG. 2 associated with both the external portion 202 and the implantable portion 204, greater than or fewer than two magnets can be utilized, as described elsewhere herein. The magnets 216 are arranged so as to be defined by a plane P. An axis A of the output shaft 214 is disposed so as to be substantially orthogonal to and extending through the plane P. The output shaft 214 itself can also extend through the plane P. As such, the axis A of the output shaft 214 is substantially parallel to and aligned with the shortest distance between the magnets 216, 234.

Figure 2B:
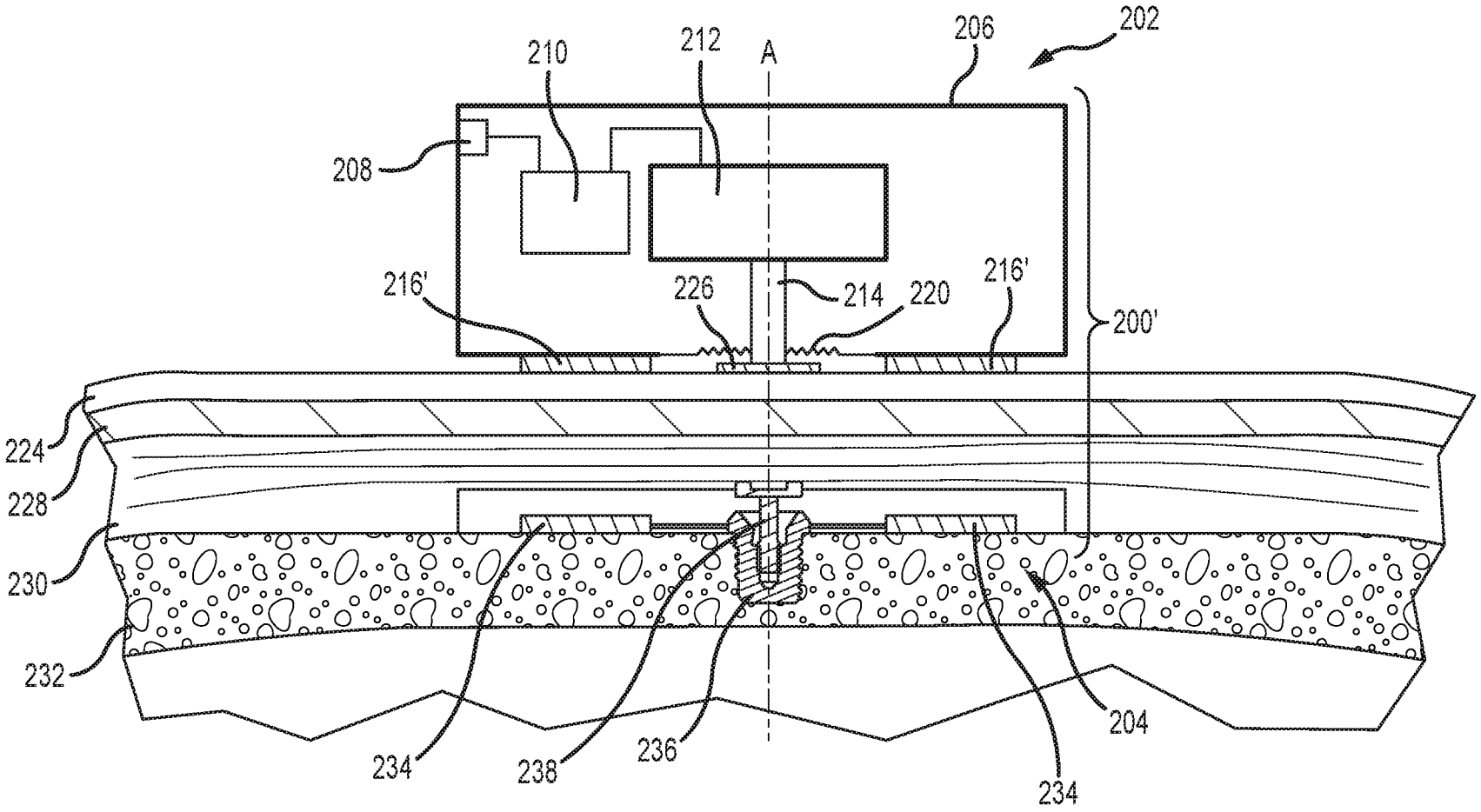

FIG. 2B depicts a partial cross-sectional view of a passive transcutaneous bone conduction device 200' worn on a recipient. The device 200' is nearly identical to the device 200 depicted in FIG. 2A, as such a number of components are not described further. The device 200' depicted in FIG. 2B differs from that of FIG. 2A in that magnets 216' are rigidly fastened to an exterior of a lower surface 218 of the external portion 202. As such, the magnets 216' are substantially coplanar with and surround the pressure plate 226. In examples, magnets 216' can be selected based on a plurality of factors, such as those described above. As such, the device 200' can be configurable so as to utilize an optimal or more desirable magnet strength based on, e.g., implantation depth.

Figure 3A:
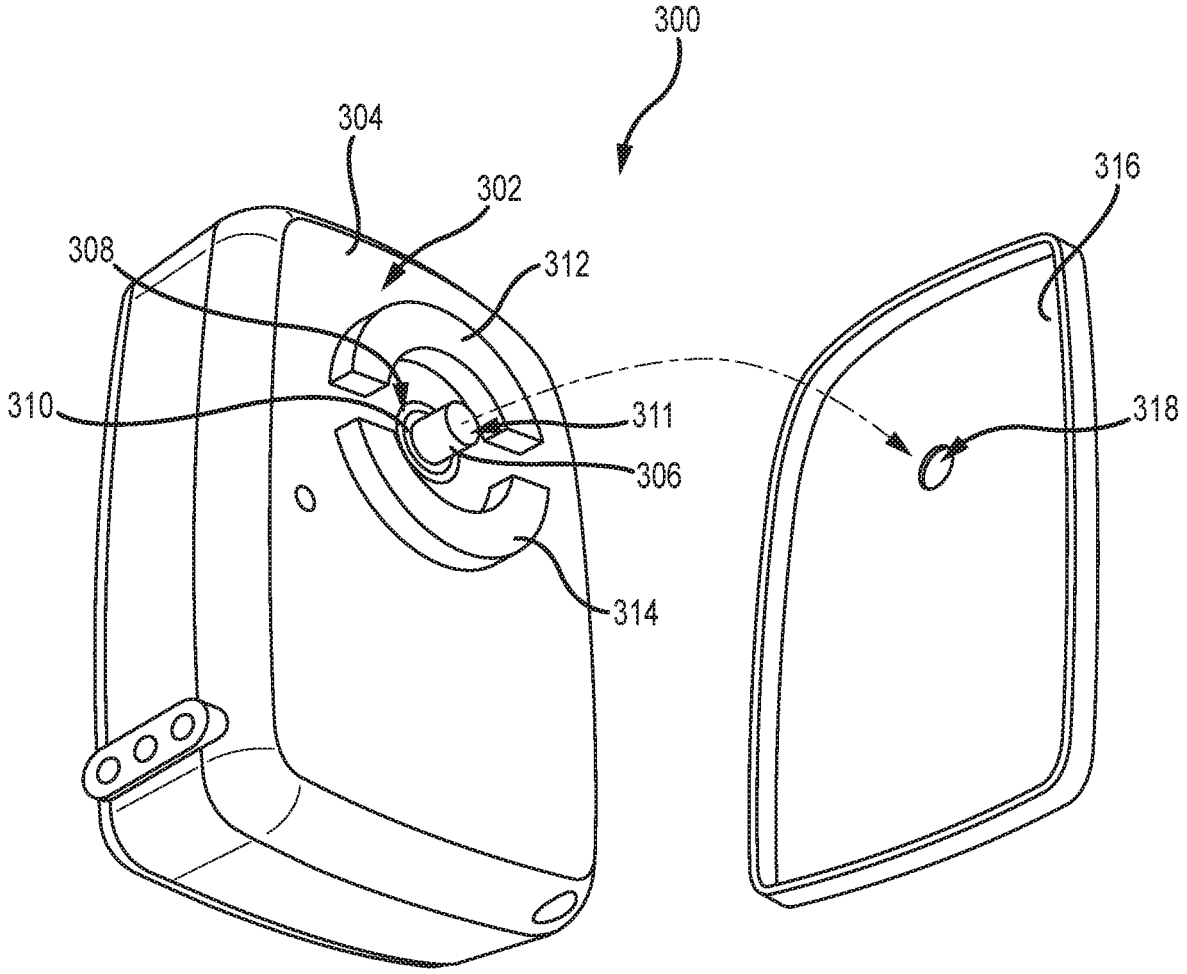
FIGS. 3A and 3B depict bottom perspective views of magnet systems for passive transcutaneous bone conduction devices in accordance with examples of the technology.
Figure 3B:
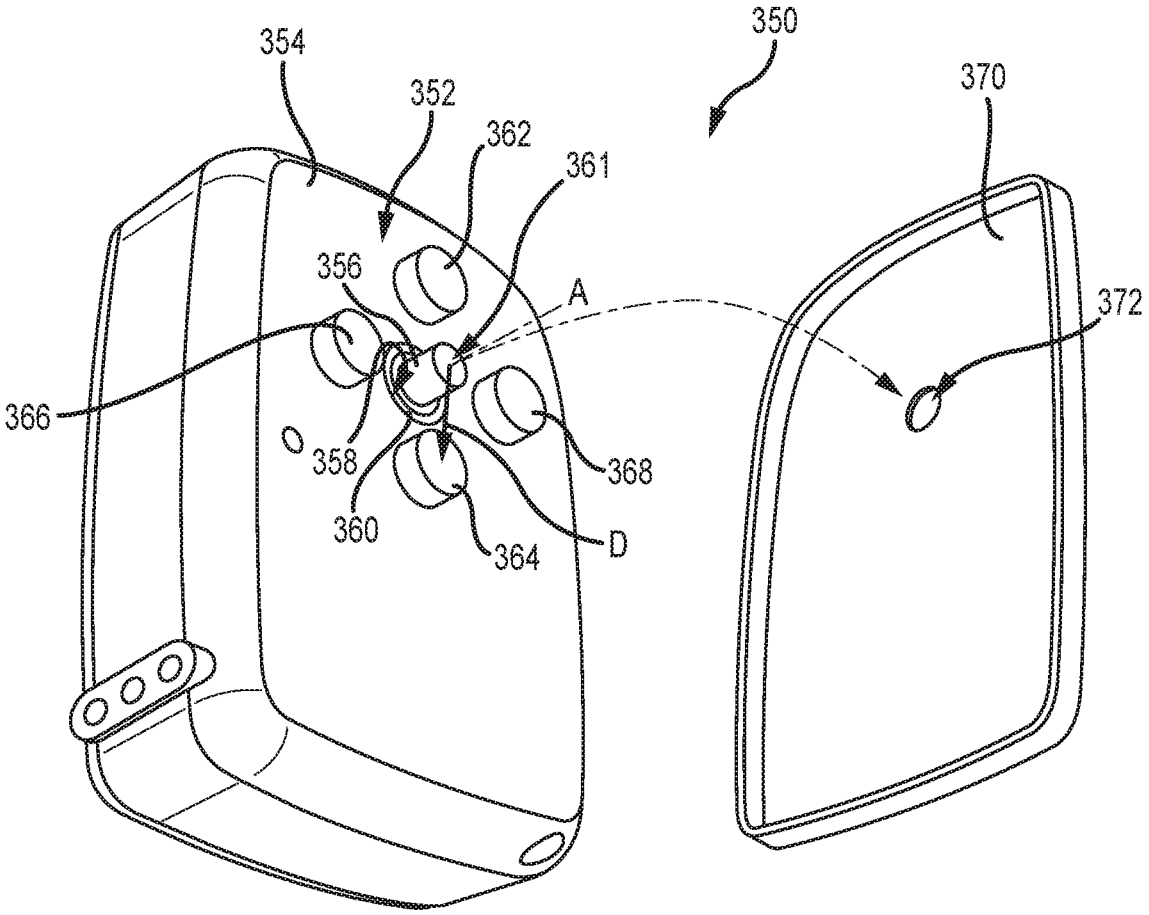

FIGS. 3A and 3B depict bottom perspective views of magnet systems 300 for passive transcutaneous bone conduction devices in accordance with examples of the technology. In FIG. 3A, the magnet system 300 is fixed on an exterior of a lower surface 302 of a bone conduction device housing 304. An output shaft 306 projects through an opening 308 in the lower surface 302 and a flexible seal 310 spans the opening 308 to the shaft 306 so as to prevent the ingress of contaminants. Here, the output shaft 306 terminates without an enlarged pressure plate, as described in the above figures. As such, an end surface 311 of the output shaft 306 is configured to contact a skin surface of a recipient and transmit vibration thereto. In another example, the end surface 311 can have disposed thereon a soft pad configured to contact the skin surface while reducing irritation and/or improve transmission of vibrations, e.g., by using a non-Newtonian material. The magnet system 300 includes two magnets 312, 314 that together form a doughnut shape substantially about the shaft 306 (as well as the axis A extending along the shaft 306). As such, the magnet system 300 is disposed symmetrically about the axis A. A complementary implanted magnet system would be implanted within the recipient for engagement with the magnet system 300 depicted. As such, when the magnet system 300 is disposed proximate the complementary implanted magnet system, the magnets 312, 314 bear against that complementary system.

Given the symmetrical layout of the magnet system 300, the axis A of the shaft 306 is generally centrally disposed within the magnetic field generated by the magnet system 300 and implanted magnet system (not shown). Another way to characterize the spatial relationship between the magnet system 300 and the shaft 306 is that the shaft 306 is aligned with a center of mass of the magnet system 300. As each magnet 312, 314 is identical, of a consistent form factor, and is spaced an equal distance from the axis A, the center of mass of the magnet system 300 is easy to identify. By disposing the axis A of the shaft 306 centrally within the magnetic field or aligned with the center of mass of the magnets, the vibrations are evenly transmitted to the recipient. A base plate 316 can be secured to the device housing 304 so as to cover the magnet system 300 to provide a smooth skin-engaging surface. An opening 318 defined by the plate 316 allows for passage of the shaft 306. Although not depicted, the shaft 306 can terminate at an enlarged pressure plate, such as that depicted in FIGS. 2A and 2B.

In FIG. 3B, the magnet system 350 is fixed on an exterior of a lower surface 352 of a bone conduction device housing 354. An output shaft 356 projects through an opening 358 in the lower surface 352 and a flexible seal 360 spans the opening 358 to the shaft 356 so as to prevent the ingress of contaminants. The magnet system 350 includes four magnets 362, 364, 366, 368, each spaced evenly about the axis A, although other locations are contemplated. Each magnet 362, 364, 366, 368 is disposed a common distance D from the axis A of the shaft 356, and as such, the magnet system 350 is disposed symmetrically about the axis A. A complementary implanted magnet system is implanted within the recipient for engagement with the magnet system 350 depicted. Like the configuration of FIG. 3A, the symmetrical layout of the magnet system 350 allows the axis A of the shaft 356 to be substantially aligned with the magnetic field generated by the magnet system 350 and implanted magnet system. Additionally, the shaft 356 is aligned with a center of mass of the magnet system 350. Examples of magnet systems having other magnet configurations and arrangements are contemplated. A base plate 370 defining an opening 372 can also be utilized.

Figure 4:
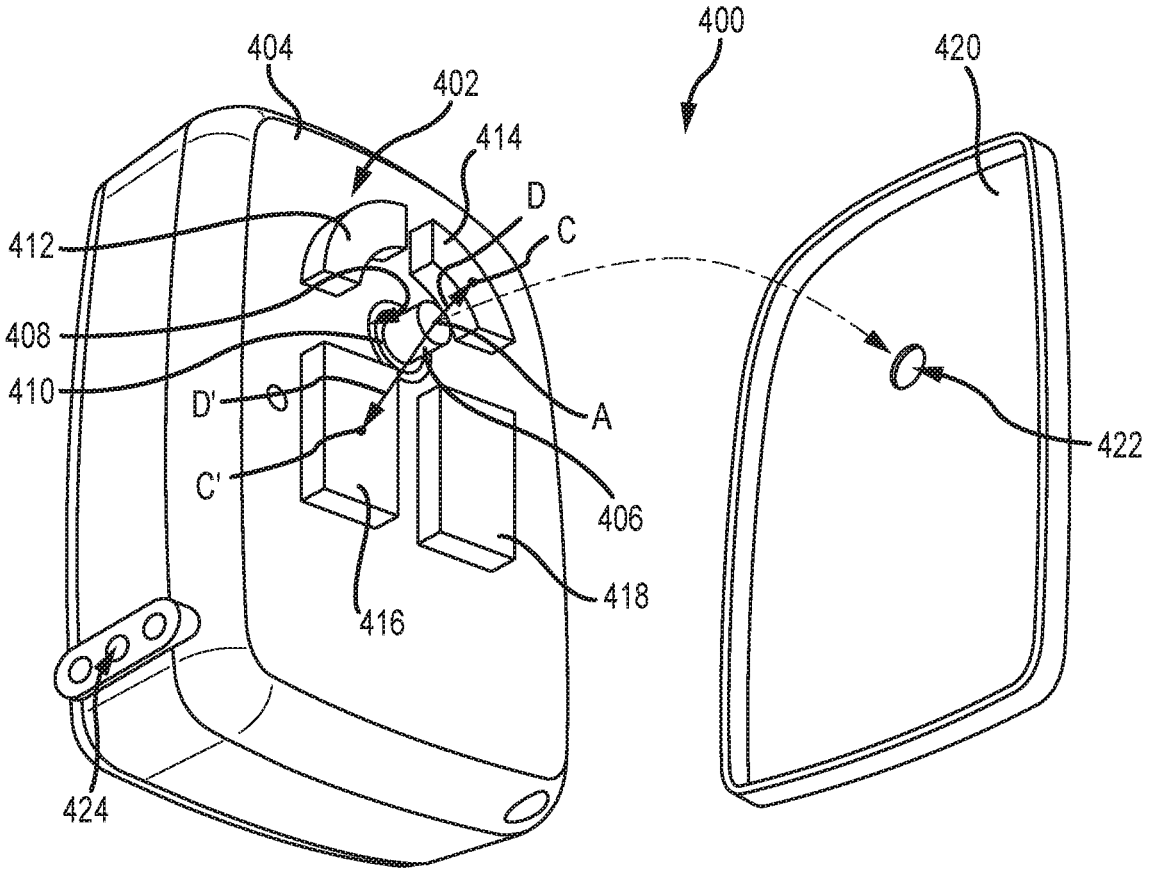
FIG. 4 depicts a bottom perspective view of a magnet system for a passive transcutaneous bone conduction device in accordance with another example of the technology.

The magnet systems of the above figures depict symmetrical magnet systems where the magnets are disposed evenly about the output shaft. The housing-mounted magnet systems described herein, however, need not be arranged symmetrically or evenly about the output shaft. For example, FIG. 4 depicts a bottom perspective view of a magnet system 400 for a passive transcutaneous bone conduction device that is not symmetrically arranged about the output shaft 406. As with the other examples depicted herein, the output shaft 306 projects through an opening 408 in a lower surface 402 of a device housing 404 and a flexible seal 410 spans the opening 408 to the shaft 406 so as to prevent the ingress of contaminants. The magnet system 400 includes four magnets 412, 414, 416, 418, each disposed about the axis A, although other locations are contemplated. Magnets 412, 414 share the same arcuate form factor, while magnets 416, 418 share the same rectangular form factor. As such, the axis A is disposed a first distance D from a center point C of magnets 412, 414. Due to the size and shape of magnets 416, 418, however, the axis A is disposed a second distance D' from a center point C' of magnets 416, 418. As such, since the distances D and D' are different, the magnets 412, 414, 416, 418 are not disposed symmetrically about the shaft 406, and the shaft 406 is not located at the center of mass of the magnet system 400. A base plate 420 defining an opening 422 can also be utilized.

Asymmetrically-oriented magnet systems, such as the configuration depicted in FIG. 4, display certain of the advantages of symmetrical magnet systems, as well as other advantages typically not present in symmetrical magnet systems. For example, since the magnets 412, 414, 416, 418 surround the shaft 406, this configuration allows for even transmission of vibrational stimuli to the recipient. Additionally, this asymmetrical arrangement can result in only a single orientation between the external magnets 412, 414, 416, 418 and the associated implantable magnets, when the device is worn by a recipient. As such, components such as sound input elements 424 (e.g., microphones) can be desirably placed (e.g., facing forward on a recipient) so as to improve performance.

Figure 5A:
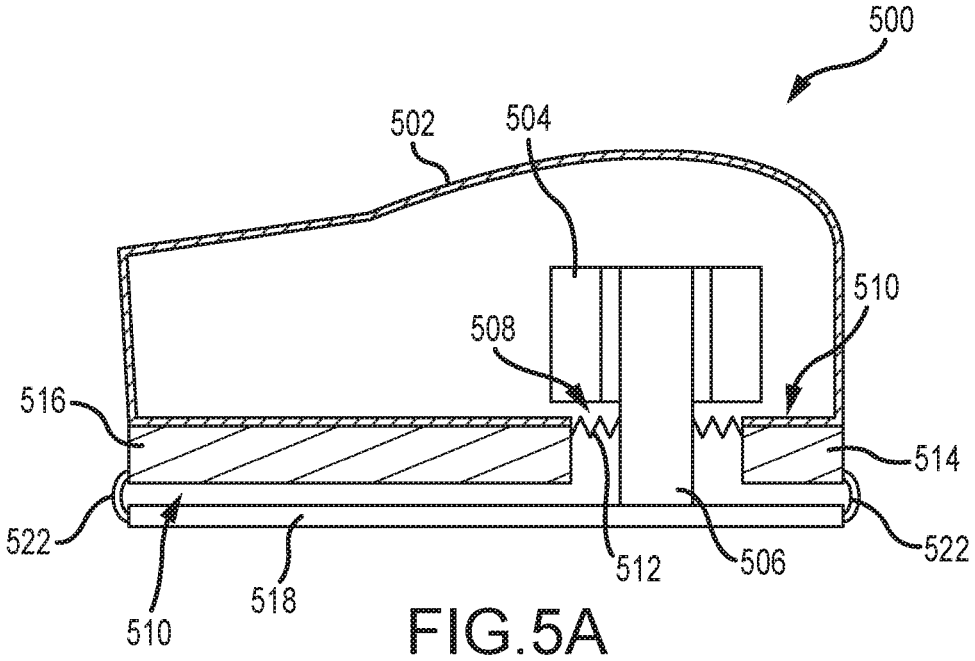
FIGS. 5A and 5B depict partial cross-sectional schematic views of passive transcutaneous bone conduction devices.
Figure 5B:
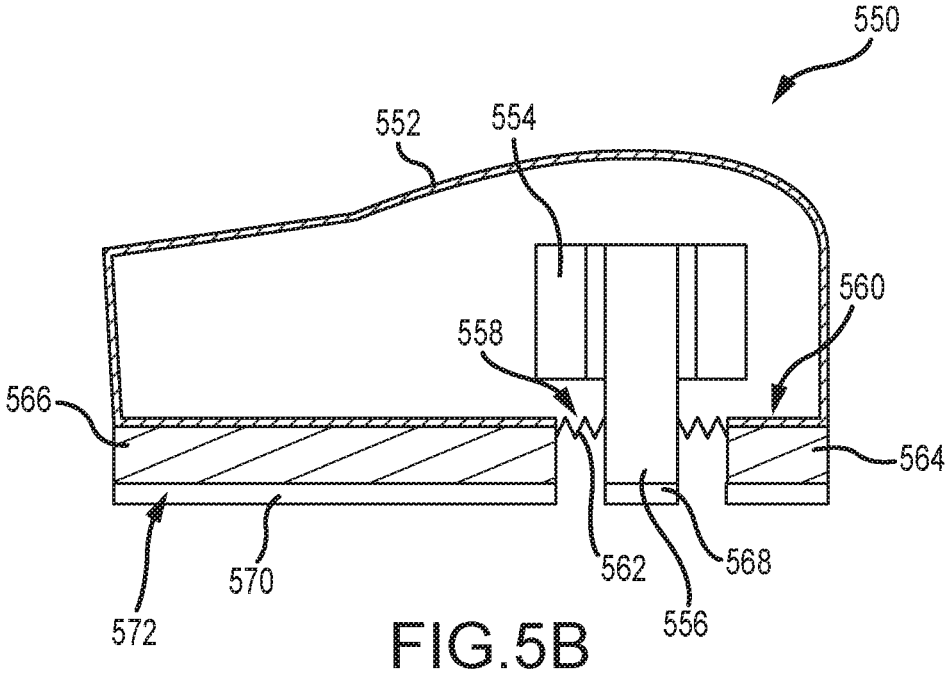

FIGS. 5A and 5B depict partial cross-sectional schematic views of passive transcutaneous bone conduction devices. Components such as microphones, sound processors, batteries, etc., are not depicted for clarity. In FIG. 5A, the bone conduction device 500 includes a housing 502 having a vibration actuator 504 disposed therein. An output shaft 506 extends from the vibration actuator 504 and extends out of an opening 508 defined by a lower surface 510 of the housing 502. A suspension spring element 512 spans the opening 508 and supports the output shaft 506 and the vibration actuator 504. A pressure plate 518 contacts the output shaft 506 (and in certain examples, can be rigidly connected thereto), so as to transmit stimuli to the recipient. As such, the suspension spring element 512 can be configured to bias the plate 518 toward the recipient so as to improve stimuli transmission. An air gap 520 is defined at least in part by the magnets 514, 516 and the plate 518 so as to reduce the transmission of vibrational stimuli back to the housing 502 and the components contained therein. A flexible sealing element 522, such as a flexible gasket, can connect the plate 518 to the magnets 514, 516 so as to prevent intrusion of contaminants.

In FIG. 5B, the bone conduction device 550 includes a housing 552 having a vibration actuator 554 disposed therein. An output shaft 556 extends from the vibration actuator 554 and extends through an opening 558 defined by a lower surface 560 of the housing 552. A spring element 562 spans the opening 558 and also seals the opening against contaminant intrusion. In that case, the spring element 562 can be a resilient elastic element in the shape of a ring or a washer, and be connected to both the shaft 556 and an edge of the opening 558. A number of magnets 564, 566 are connected to the lower surface 560 of the housing 552. At an end of the shaft 556 opposite the vibration actuator 554, a pressure plate 568 transmits vibrational stimuli to the recipient. A base plate 570 discrete from the pressure plate 568 is disposed on an underside of the magnets 564, 566. The base plate 570 can be for aesthetic or other purposes. For example, the base plate 570 can be a single non-magnetic plate that covers the plurality of magnets 564, 566 so as to define a smooth, continuous bottom surface 572 of the device 550. In another example, the base plate 570 can be (or be connected to) a flexible pad or element that increases recipient comfort.

Figure 6A:
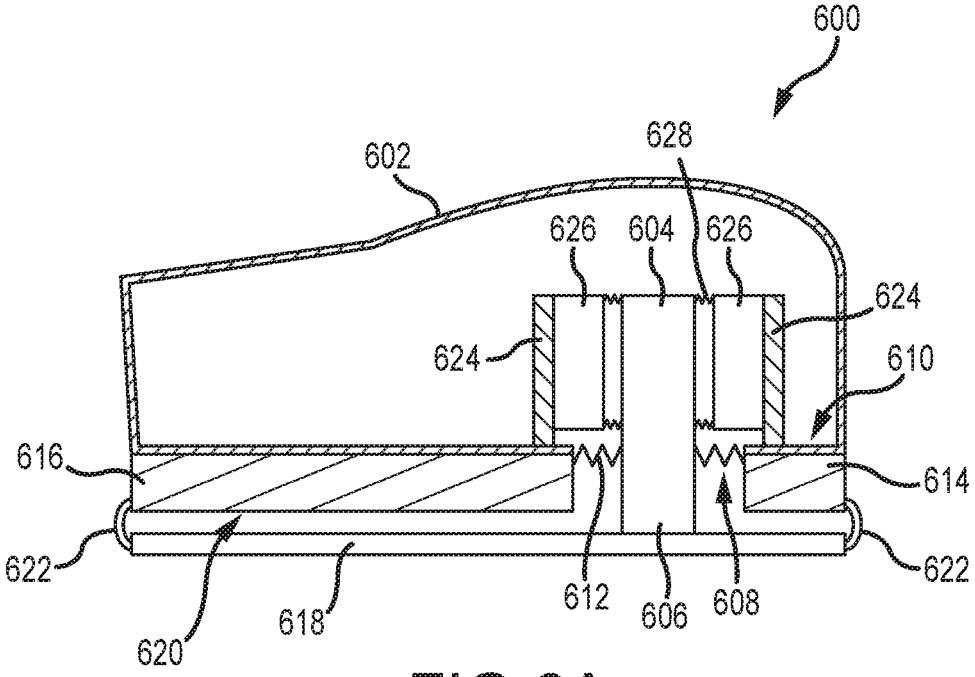
FIGS. 6A and 6B depict partial cross-sectional schematic views of passive transcutaneous bone conduction devices.
Figure 6B:
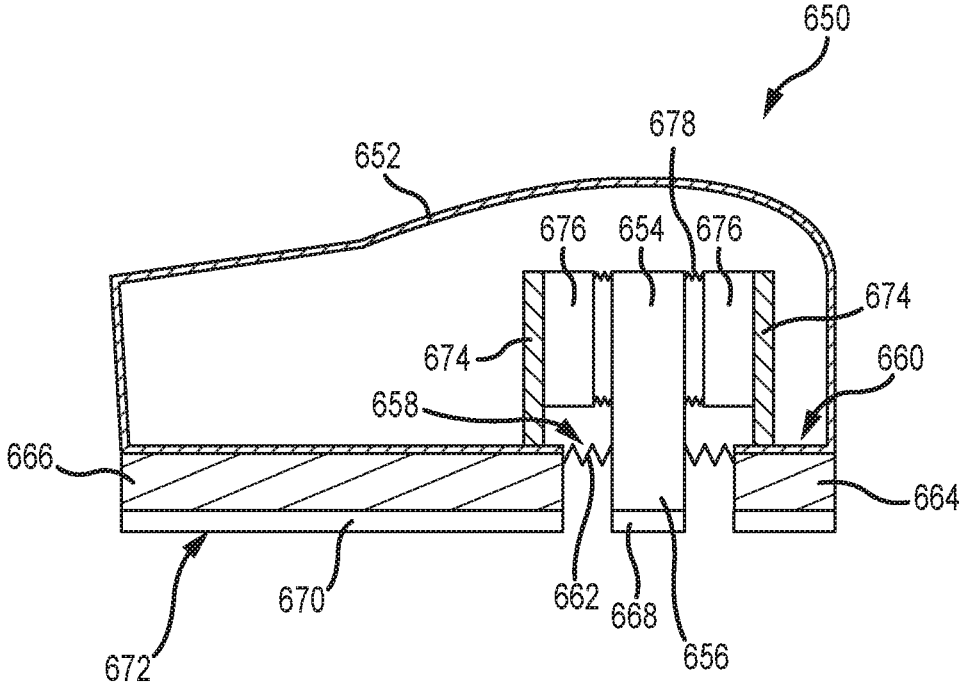

FIGS. 6A and 6B depict partial cross-sectional schematic views of passive transcutaneous bone conduction devices. Components such as microphones, sound processors, batteries, etc., are not depicted for clarity. In FIG. 6A, the bone conduction device 600 includes a housing 602 having a vibration actuator 604 disposed therein. An output shaft 606 extends from the vibration actuator 604 and extends through an opening 608 defined by a lower surface 610 of the housing 602. A suspension spring element 612 spans the opening 608. A number of magnets 614, 616 are connected to the lower surface 610 of the device 600. A pressure plate 618 contacts the output shaft 606 (and in certain examples, can be rigidly connected thereto), so as to transmit stimuli to the recipient. An air gap 620 is defined at least in part by the magnets 614, 616 and the plate 618 so as to reduce the transmission of vibrational stimuli back to the housing 602 and the components contained therein. A flexible sealing element 622, such as a flexible gasket can connect the plate 618 to the magnets 614, 616 so as to prevent intrusion of contaminants. The device 600 differs from the similar device 500 of FIG. 5A in that a rigid or semi-rigid structure or scaffold 624 rigidly mounts the vibration actuator 604 (more specifically, the counterweights 626 thereof) to the housing 602. As such, the counterweights 626, magnets 614, 616, and housing 602 form almost the entire seismic mass of the device 600. Springs 628 connect this seismic mass to the output shaft 606.

In FIG. 6B, the bone conduction device 650 includes a housing 652 having a vibration actuator 654 disposed therein. An output shaft 656 extends from the vibration actuator 654 and extends through an opening 658 defined by a lower surface 660 of the housing 652. A spring element 662 spans the opening 658 and also seals the opening 658 against contaminant intrusion. In that case, the spring element 662 can be a resilient elastic element in the shape of a ring or a washer, and be connected to both the shaft 656 and an edge of the opening 658. A number of magnets 664, 666 are connected to the lower surface 660 of the housing 652. At an end of the shaft 656 opposite the vibration actuator 654, a pressure plate 668 transmits vibrational stimuli to the recipient. A base plate 670 discrete from the pressure plate 668 is disposed on an underside of the magnets 664, 666 and can be a single non-magnetic plate that covers the plurality of magnets 664, 666 so as to define a smooth, continuous bottom surface 672 of the device 650. In another example, the base plate 670 can be (or be connected to) a flexible pad or element that increases recipient comfort. Again, like the example of FIG. 6A, the device 650 includes a rigid or semi-rigid structure or scaffold 674 rigidly mounts the vibration actuator 654 (more specifically, the counterweights 676 thereof) to the housing 652 so as to form much of the seismic mass of the device 650. Springs 678 connect this seismic mass to the output shaft 656.

Figure 7A:
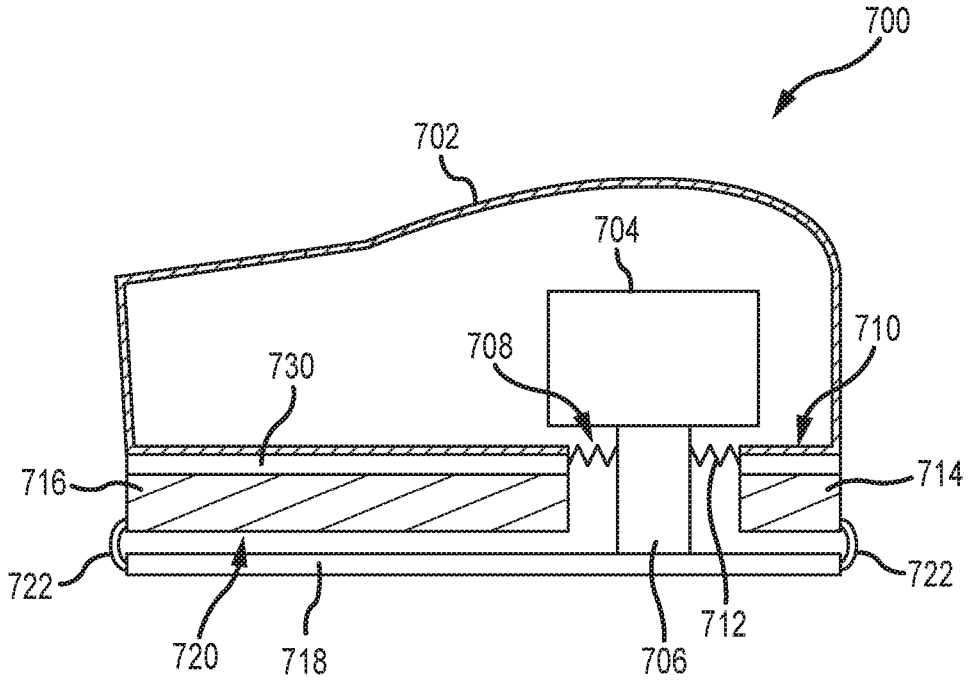
FIGS. 7A-7C depict partial cross-sectional schematic views of passive transcutaneous bone conduction devices.
Figure 7B:
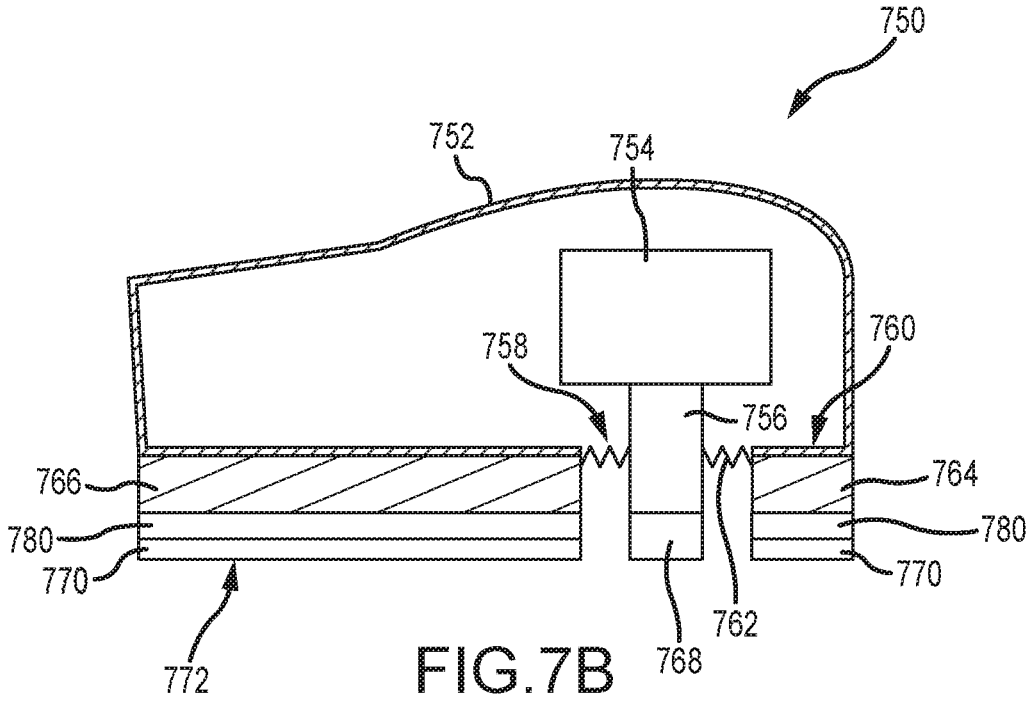
Figure 7C:
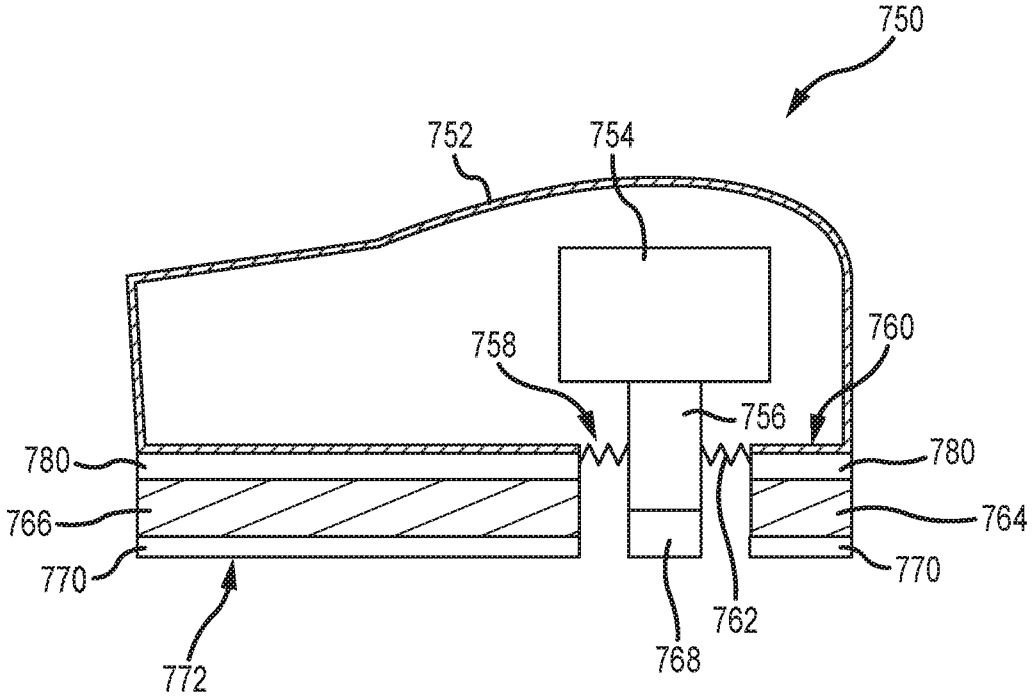

FIGS. 7A-7C depict partial cross-sectional schematic views of passive transcutaneous bone conduction devices. In FIG. 7A, the bone conduction device 700 includes a housing 702 having a vibration actuator 704 disposed therein. An output shaft 706 extends from the vibration actuator 704 and through an opening 708 defined by a lower surface 710 of the housing 702. A suspension spring element 712 spans the opening 708 and supports the output shaft 712 and the vibration actuator 704. A pressure plate 718 contacts the output shaft 706 (and in certain examples, can be rigidly connected thereto), so as to transmit stimuli to the recipient.

As such, the suspension spring element 712 can be configured to bias the plate 718 toward the recipient so as to improve stimuli transmission. An air gap 720 is defined at least in part by the magnets 714, 716 and the plate 718 so as to reduce the transmission of vibrational stimuli back to the housing 702 and the components contained therein. A flexible sealing element 722, such as a flexible plastic gasket can connect the plate 718 to the magnets 714, 716 so as to prevent intrusion of contaminants. The device 700 also includes a vibration isolator in the form of a flexible component 730 proximate the magnets 714, 716 that can limit the transmission of vibrations from the skin to the sound input element(s) (not shown) disposed on the housing 702. The flexible component 730 can be a porous material, fibrous material, gel material, or other type of soft material. Resilient foams, for example, can be utilized.

In both FIGS. 7B and 7C, the bone conduction device 750 includes a housing 752 having a vibration actuator 754 disposed therein. An output shaft 756 extends from the vibration actuator 754 and through an opening 758 defined by a lower surface 760 of the housing 752. A spring element 762 spans the opening 758 and also seals the opening against contaminant intrusion. In that case, the spring element 762 can be a resilient elastic element in the shape of a ring or a washer, and be connected to both the shaft 756 and an edge of the opening 758. A number of magnets 764, 766 are connected to the lower surface 760 of the housing 752. At an end of the shaft 756 opposite the vibration actuator 754, a pressure plate 768 transmits vibrational stimuli to the recipient. A base plate 770 discrete from the pressure plate 768 is disposed on an underside of the magnets 764, 766. The base plate 770 can be for aesthetic or other purposes. For example, the base plate 770 can be a single non-magnetic plate that covers the plurality of magnets 764, 766 so as to define a smooth, continuous bottom surface 772 of the device 750. The devices 750 of FIGS. 7B and 7C, however, also include a flexible component 780 proximate the magnets 764, 766 that can limit the transmission of vibrations from the skin to the sound input element(s) (not shown) disposed on the housing 752.

Figure 8A:
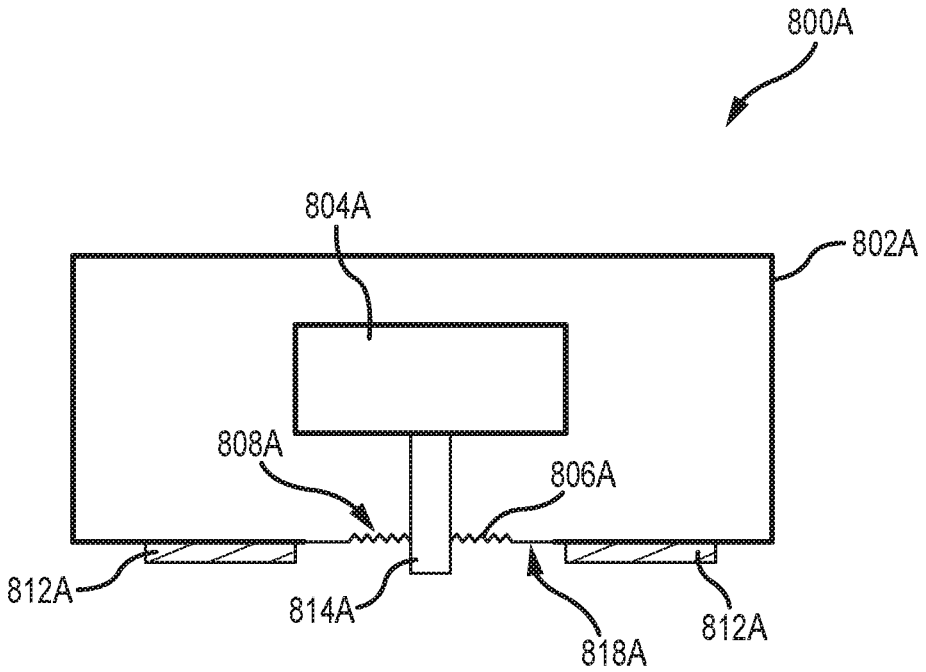
FIGS. 8A-8D depict partial cross-sectional schematic views of bone conduction devices.
Figure 8B:
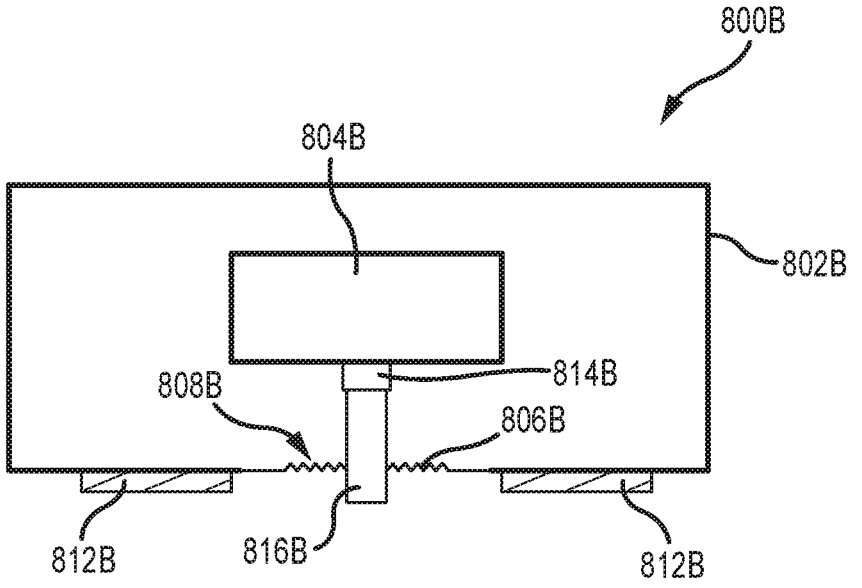
Figure 8C:
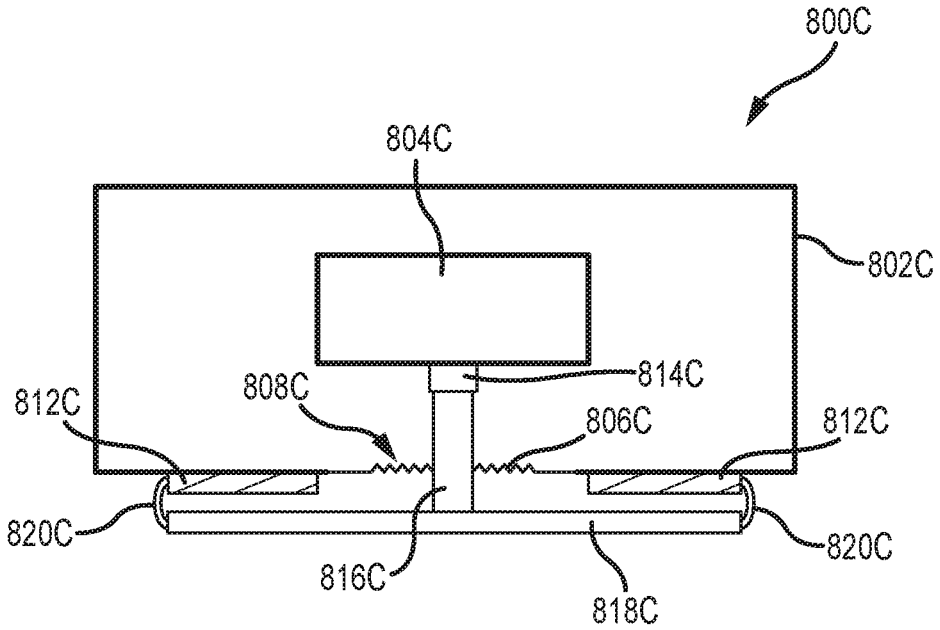

FIGS. 8A-8C depict partial cross-sectional schematic views of bone conduction devices 800A-C. A number of components are not depicted for clarity. Common elements of each of the devices 800A-C are described simultaneously. Each device 800A-C includes a housing 802A-C in which is contained a vibrating actuator 804A-C. A sealing element 806A-C seals an opening 808A-C in a lower surface 810A-C of the housing 802A-C. Retention magnets 812A-C are also connected to the lower surface 810A-C, as described elsewhere herein. FIG. 8A depicts an output shaft 814A that is connected to the vibration actuator 804A. As such, the device 800A could be considered a dedicated transcutaneous bone conduction device since the output shaft 814A can only exert stimuli against a recipient in a transcutaneous configuration.

The devices 800B-C of FIGS. 8B-C, can be more versatile, however, due to the shortened output shaft 814B-C. In FIG. 8B, for example, output shaft 814B can be connected to a coupling shaft 816B configured to contact a skin surface. In FIG. 8C, the output shaft 814C can be connected to a coupling shaft 816C that is connected to a pressure plate 818C as depicted elsewhere herein, along with a sealing element 820C, if desired.

Figure 8D:
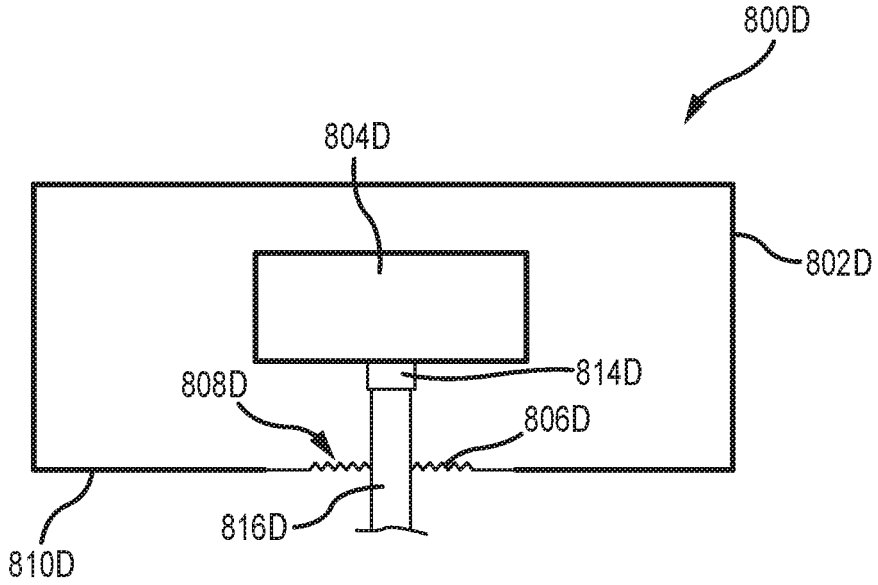

Device 800D is a variant of the device 800B-C and is depicted in FIG. 8D. Notably, the coupling shaft 816D is an anchor that connects the device 800D so as to be utilized in a percutaneous bone conduction configuration, where the vibration actuator 804D delivers stimuli directly to the skull via a bone anchor. In this configuration, the magnets depicted in FIGS. 8B-8C have been removed, since they are unnecessary in a percutaneous configuration. The examples of FIGS. 8B-8D show the versatility that can be available in devices having removable magnets with a variety of different coupling shaft configurations.

FIGS. 2A-8C depict examples of a passive transcutaneous bone conduction device with distinct retention and transmission components. The retention magnets that hold the external component to a recipient are connected to a non-vibratory portion device. The vibration actuator connects to a dedicated pressure plate with no retention function (i.e. the weight of the external component is not supported via the pressure plate and actuator). This allows the retention and transmission components of the bone conduction device to be independently optimized.

The retention magnets connect to a non-vibratory structure of the bone conduction device, such as the sound processor housing. The non-vibratory structure of the external component is decoupled from the vibrating system by the actuator springs, and in certain examples an outer suspension system positioned between the actuator and the housing. This reduces the weight of the vibrating system, which typically includes the vibrating part of the actuator (such as the bobbin, coil windings and output shaft for a balanced variable reluctance transducer), the pressure plate (including any padding attached to the skin facing surface), and the coupling that connects the actuator to the pressure plate.

The retention magnets secure the device to a recipient and support the full weight of the external component when worn. The output force from the reciprocating actuator is generally normal to the skin interface and aligned with the transcutaneous retention force. This force distribution retains the pressure plate in contact with the recipient's skin during stimulation, without an ancillary retention system (such as an ear hook or adhesive patch). The pressure plate protrudes marginally beyond the retention magnets and skin facing surface of the device so that the transcutaneous retention force preloads the suspension of the vibrating system. This biases the pressure plate toward the recipient's skin. The retention magnets can be disposed around the pressure plate in a symmetrical layout that produces a substantially even contact pressure at the skin interface.

This disclosure described some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art.

Although specific aspects are described herein, the scope of the technology is not limited to those specific examples. One skilled in the art will recognize other examples or improvements that are within the scope of the present technology. Therefore, the specific structure, acts, or media are disclosed only as illustrative examples. The scope of the technology is defined by the following claims and any equivalents therein.

What is claimed is:

1. A passive transcutaneous bone conduction device, comprising:

at least one external retention magnet configured to hold the passive transcutaneous bone conduction device against skin of a recipient of the passive transcutaneous bone conduction device; and a pressure plate configured to deliver vibrations from the passive transcutaneous bone conduction device to the skin of the recipient to evoke a hearing percept, wherein the pressure plate is vibrationally decoupled from the at least one external retention magnet.

2. The passive transcutaneous bone conduction device of claim 1, wherein the at least one external retention magnet is connected to a non-vibratory portion of the passive transcutaneous bone conduction device, thereby vibrationally decoupling the pressure plate from the at least one external retention magnet.

3. The passive transcutaneous bone conduction device of claim 2, wherein the non-vibratory portion comprises a housing of the passive transcutaneous bone conduction device.

4. The passive transcutaneous bone conduction device of claim 3, further comprising:

a suspension system positioned between a vibration actuator of the passive transcutaneous bone conduction device and the housing.

5. The passive transcutaneous bone conduction device of claim 1, wherein the at least one external retention magnet is directly coupled to a portion of the passive transcutaneous bone conduction device other than the pressure plate.

6. The passive transcutaneous bone conduction device of claim 1, wherein the at least one retention magnet is configured to support a full weight of the passive transcutaneous bone conduction device when secured to the recipient.

7. The passive transcutaneous bone conduction device of claim 1, further comprising a housing, wherein the at least one external retention magnet is disposed on an exterior of the housing; and wherein a vibration actuator is disposed within the housing.

8. The passive transcutaneous bone conduction device of claim 1, wherein the passive transcutaneous bone conduction device defines an air gap between the pressure plate and the at least one external retention magnet, wherein the air gap vibrationally decouples the pressure plate from the at least one external retention magnet.

9. An auditory prosthesis, comprising:

an external housing;

a vibration actuator disposed within the external housing;

an external retention magnet configured to magnetically couple the external housing to an implanted component of the auditory prosthesis; and an external pressure plate coupled to the vibration actuator and configured to transmit vibrational stimuli to a recipient, wherein the auditory prosthesis is configured to reduce transmission of the vibrational stimuli to the external housing.

10. The auditory prosthesis of claim 9, further comprising:

an output shaft extending from the vibration actuator and through an opening in the housing, wherein the output shaft couples the pressure plate to the vibration actuator.

11. The auditory prosthesis of claim 10, wherein a lower surface of the housing defines the opening in the housing; and wherein the external retention magnet is located on the lower surface.

12. The auditory prosthesis of claim 11, further comprising:

a base plate discrete from the pressure plate and disposed on an underside of the external retention magnet.

13. The auditory prosthesis of claim 10, further comprising:

a suspension spring element spanning the opening, wherein the suspension spring element is configured to support the output shaft and the vibration actuator.

14. The auditory prosthesis of claim 9, further comprising:

a flexible sealing element connecting the pressure plate to the external retention magnet.

15. The auditory prosthesis of claim 9, further comprising:

a suspension spring configured to bias the pressure plate toward the recipient.

16. The auditory prosthesis of claim 9, wherein the retention magnet and the pressure plate define an air gap for reducing the transmission of the vibrational stimuli to the housing.

17. The auditory prosthesis of claim 9, wherein the external retention magnet is configured to support a full weight of the auditory prosthesis when secured to the recipient.

18. The auditory prosthesis of claim 9, wherein the external retention magnet is one of a plurality of retention magnets of the auditory prosthesis, wherein the plurality of retention magnets are disposed in a symmetrical layout around the pressure plate.

19. An apparatus, comprising:

an external housing;

a vibration actuator disposed within the housing and configured to transmit vibrational stimuli to a recipient;

a sound input element coupled to the external housing;

an external vibration isolator configured to limit transmission of vibrations from the recipient to the sound input element; and an external retention magnet.

20. The apparatus of claim 19, wherein the external vibration isolator includes a flexible component disposed between the retention magnet and the housing.

21. The apparatus of claim 19, wherein the external vibration isolator includes at least one or more of: a porous material, a fibrous material, a gel material, and a resilient foam.

22. The apparatus of claim 19, wherein the housing has a lower surface, wherein the external vibration isolator is disposed between the retention magnet and the lower surface.

23. The apparatus of claim 22, wherein a base plate is coupled to the external vibration isolator and defines a smooth bottom surface of the apparatus.

24. The apparatus of claim 19, wherein the external housing has a lower surface, wherein the external retention magnet is disposed between the external vibration isolator and the lower surface.

25. The apparatus of claim 19, wherein the external retention magnet is coupled to a static part of the apparatus.

* * * * *